US008293037B2

(12) United States Patent
Suwabe et al.

(10) Patent No.: US 8,293,037 B2
(45) Date of Patent: Oct. 23, 2012

(54) METHOD FOR PRODUCING DUPLEX STAINLESS STEEL PIPE

(75) Inventors: Hitoshi Suwabe, Itami (JP); Toshihide Ono, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 13/184,732

(22) Filed: Jul. 18, 2011

(65) Prior Publication Data

US 2011/0290377 A1 Dec. 1, 2011

Related U.S. Application Data

(63) Continuation of application No. PCT/JP2009/068743, filed on Nov. 2, 2009.

(30) Foreign Application Priority Data

Jan. 19, 2009 (JP) ..... 2009-008403

(51) Int. Cl.
*C21D 8/10* (2006.01)

(52) U.S. Cl. ..... 148/593; 148/519; 148/592; 148/609; 148/650; 148/909; 148/506; 148/610

(58) Field of Classification Search ..... 148/325–327, 148/519, 592, 593, 605–611, 650, 909, 506
See application file for complete search history.

(56) References Cited

U.S. PATENT DOCUMENTS 5,733,387 A * 3/1998 Lee et al. ..... 148/325

FOREIGN PATENT DOCUMENTS

| | | | |
|---|---|---|---|
| JP | 60-89519 | * | 5/1985 |
| JP | 02-290920 | | 11/1990 |
| JP | 05-277611 | | 10/1993 |
| JP | 07-207337 | | 8/1995 |
| JP | 11-302801 | | 11/1999 |
| WO | 2009/014001 | | 1/2009 |

* cited by examiner

*Primary Examiner* — Deborah Yee
(74) *Attorney, Agent, or Firm* — Clark & Brody

(57) ABSTRACT

A method for producing a duplex stainless steel pipe having a minimum yield strength of 758.3 to 965.2 MPa, comprises first hot working and optionally solution heat treating a duplex stainless steel material pipe having a chemical composition consisting, by mass %, of C: 0.03% or less, Si: 1% or less, Mn: 0.1 to 4%, Cr: 20 to 35%, Ni: 3 to 10%, Mo: 0 to 6%, W: 0 to 6%, Cu: 0 to 3% and N: 0.15 to 0.60%, the balance being Fe and impurities. The pipe is then cold rolled under conditions that the working ratio Rd, in terms of the reduction of area, in the final cold rolling step falls within a range from 10 to 80%, and formula (1) is satisfied:

$$Rd=\exp[\{\ln(MYS)-\ln(14.5\times Cr+48.3\times Mo+20.7\times W+6.9\times N)\}/0.195] \quad (1)$$

wherein Rd is a reduction in area %, MYS is the targeted yield strength (MPa), and Cr, Mo, W and N are in mass %.

2 Claims, 2 Drawing Sheets

METHOD FOR PRODUCING DUPLEX STAINLESS STEEL PIPE

U.S. Application as Continuation of PCT/JP2009/068743

TECHNICAL FIELD

The present invention relates to a method for producing a duplex stainless steel pipe that exhibits excellent corrosion resistance even in a carbon dioxide gas corrosive environment or in a stress corrosive environment, and at the same time has a high strength. The duplex stainless steel pipe produced according to the present invention can be used for, for example, oil wells or gas wells (hereinafter, collectively referred to as "oil wells").

BACKGROUND ART

In deep oil wells or oil wells in severe corrosive environments involving corrosive substances such as humid carbon dioxide gas ($CO_2$), hydrogen sulfide ($H_2S$) or chloride ion ($Cl^-$), austenite-ferrite duplex stainless steel pipes having a large content of Cr such as 22Cr steel or 25Cr steel are used as oil well pipes.

These austenite-ferrite duplex stainless steels as having been subjected to the solution treatment usually applied in the production thereof can attain at most such a strength that tensile strength (TS) is of the grade of 80 kgf/mm$^2$ (785 MPa) and yield strength (0.2% yield stress) is of the grade of 60 kgf/mm$^2$ (588 MPa). In consideration of this issue, Patent Document 1 proposes a method for obtaining a high-strength duplex stainless steel pipe that contains 0.1 to 0.3% of N is subjected to a cold working with a reduction of area of 5 to 50%, and thereafter the pipe is heated at 100 to 350° C. for 30 minutes or more to yield the desired pipe. In this case, it is claimed that a duplex stainless steel pipe having a high strength is obtained by combining the work hardening due to the cold working with the aging treatment.

However, in these years, oil wells have a remarkable tendency toward being deeper, and hence, for the purpose of the use in environments severer than those hitherto experienced, it is required to produce duplex stainless steel pipes which are high in strength, in particular, of the grade of 110 to 140 ksi (the minimum yield strength is 758.3 to 965.2 MPa) and additionally have various strength levels defined in the specifications. Thus, for that purpose, it is not sufficient to consider only the content of N as in Patent Document 1, but it is also necessary to consider the contents of the other components, and additionally it is necessary to more strictly control the cold working ratio. The production method disclosed in Patent Document 1 offers a problem of the production efficiency deterioration or the cost increase due to the addition of the aging treatment step.

For the purpose of attaining a high corrosion resistance and a high strength, Patent Document 2 discloses a method in which a Cu-containing duplex stainless steel material is subjected to a cold working with a reduction of area of 35% or more, thereafter heated and quenched, and then subjected to a warm working. This document discloses a conventional example, wherein a Cu-containing duplex stainless steel wire rod is subjected to a solid-solution heat treatment and thereafter subjected to a cold working with a reduction of area of 25 to 70%, and thus a high-strength wire rod having a tensile strength of 110 to 140 kgf/mm$^2$ has been obtained. However, this discloses only an increase of the tensile strength due to the cold working in relation to a wire rod but not with a pipe, and hence it is not clear what is the level of the yield strength significant in the material design of the oil well pipes.

Further, Patent Document 3 describes a high strength steel that can be attained by a low-reduction cold working based on forging. However, here is merely disclosed a method for improving the strength by successively forging with a cold working ratio of about 0.5 to 1.6% over the whole region, in the longitudinal direction, of a duplex stainless steel stock that has been subjected to a solution treatment while the stock is being imparted with rotation.

[Citation List]

[Patent Documents]

[Patent Document 1] JP2-290920A

[Patent Document 2] JP7-207337A

[Patent Document 3] JP5-277611A

SUMMARY OF INVENTION

Technical Problem

As described above, any one of the above-described documents discloses the fact that the cold working enables to attain a high strength. However, these documents has never investigated specifically on the high strength attained by the cold working wherein the composition of the duplex stainless steel pipe is taken into account, and has never suggested with respect to the component design or cold working conditions appropriate to attaining the targeted strength, in particular, the targeted yield strength.

In view of these circumstances, an objective of the present invention is to provide a method for producing a duplex stainless steel pipe which has not only a corrosion resistance required for the oil well pipes used in deep oil wells or in severe corrosive environments but also a targeted strength.

Solution to Problem

For the purpose of solving the above-described problems, the present inventors produced duplex stainless steel pipes by using duplex stainless steel materials having various chemical compositions under the conditions that the working ratio in the final cold rolling was diversely varied, and performed an experiment to determine the tensile strengths of these pipes; consequently, the present inventors obtained the following findings (a) to (h).

(a) The duplex stainless steel pipes used in deep oil wells or oil wells in severe corrosive environments are required to have corrosion resistance. However, when the content of C is large, the precipitation of the carbides tends to be excessive due to the thermal effects at the time of a heat treatment, welding or the like, and hence, from the viewpoints of the corrosion resistance and the workability of the steel, in particular, from the viewpoint of the corrosion resistance, it is necessary to reduce the content of C.

(b) While the content of C is reduced, the strength comes to be insufficient without applying any other working, a material pipe produced by a hot working of the duplex stainless steel material or furthermore by a solid-solution heat treatment of the duplex stainless steel material can be improved in strength by subsequently applying cold rolling Here, it is to be noted that when the working ratio Rd exceeds 80% in terms of the reduction of area, the high strength is maintained but the work hardening occurs, and hence the ductility or the toughness is deteriorated. On the other hand, when the working ratio is less than 10% in terms of the reduction of area, no intended high strength can be attained. Consequently, it is necessary to set the working ratio of the cold rolling at 10 to 80% in terms of the reduction of area.

(c) Additionally, it has been found that when the working ratio Rd at the time of performing the cold rolling is in a range from 10 to 80% in terms of the reduction of area, the larger is the working ratio Rd of the final cold rolling in the duplex stainless steel pipe, the higher is the yield strength YS obtained for the duplex stainless steel pipe, and the relation between the working ratio Rd and the yield strength YS is represented as a linear relationship.

It has also been found that the strength of the duplex stainless steel pipe is significantly affected by the content of Cr, and the higher is the content of Cr in the steel material, the higher-strength duplex stainless steel pipe can be obtained. Further, it has also been found that the strength of the duplex stainless steel pipe is also significantly affected by the content of Mo, the content of W and the content of N, and a high-strength duplex stainless steel pipe can be produced by containing Mo, W or N.

FIG. 1 is a plot of the yield strength YS (MPa) values obtained in a tensile test against the working ratio Rd (%) values in terms of the reduction of area, for the duplex stainless steel pipes having the various chemical compositions, used in Example described below. FIG. 1 shows that there occurs a correlation between the working ratio Rd in terms of the reduction of area and the yield strength YS. FIG. 1 also shows that the higher is the content of Cr or the content of W, the higher-strength duplex stainless steel pipe can be obtained.

(d) Next, the present inventors have thought up that the yield strength of the duplex stainless steel pipe is dependent on the working ratio Rd at the time of performing the cold rolling and the chemical composition of the duplex stainless steel pipe, and accordingly it comes to be possible to establish a component design technique to be associated with the pipe working conditions, appropriate to the purpose of attaining the yield strength targeted for the duplex stainless steel pipe. In other words, for the purpose of attaining the yield strength targeted for the duplex stainless steel pipe, not the fine regulation based on the chemical composition of the duplex stainless steel pipe, but the fine regulation based on the working ratio Rd at the time of performing the cold rolling comes to be realizable. Additionally, it comes to be unnecessary to perform the melting of a large number of kinds of duplex stainless steels prepared by varying the alloy composition according to the demanded strength level, and consequently, the overstock of the material billets can be suppressed.

As described above, when the appropriate component design technique associated with the pipe working conditions can be established, it is only required to perform the cold rolling, for the purpose of obtaining a duplex stainless steel pipe having a targeted strength, under the cold rolling conditions targeted by taking account of the alloy composition of the stock, namely, with the targeted working ratio Rd or the higher working ratio than the targeted working ratio, without being required to vary the alloy composition of the stock on a case-by-case basis.

(e) On the basis of such an idea as described above, the present inventors have continuously made a diligent study on the correlations among the yield strength of the duplex stainless steel pipe, the working ratio Rd at the time of performing the cold rolling and the chemical composition of the duplex stainless steel pipe. Consequently, it has been found that when the working ratio Rd at the time of performing the cold rolling falls within a range from 10 to 80% in terms of the reduction of area, the yield strength YS (MPa) of the duplex stainless steel pipe can be calculated on the basis of the working ratio Rd at the time of performing the cold rolling and the individual contents of Cr, Mo, W and N in the chemical composition of the duplex stainless steel pipe, and on the basis of the following formula (2):

$$YS=(14.5\times Cr+48.3\times Mo+20.7\times W+6.9\times N)\times(Rd)^{0.195} \quad (2)$$

wherein YS and Rd signify the yield strength (MPa) and the working ratio (%) in terms of the reduction of area, respectively, and Cr, Mo, W and N signify the contents (mass %) of the respective elements.

In general, examples of the method of cold working include a cold drawing using a drawing machine with a die and a plug and a cold rolling using a pilger mill with roll-dies and a mandrel. However, the present inventors have found that even when the working ratios determined by the same reduction of area are concerned, the strength of the pipe obtained by cold drawing is higher than the strength of the pipe of the present invention obtained by cold rolling, and the above-described formula (2) is not applicable to the relationship between the working ratio Rd in the cold drawing and the yield strength YS (MPa). Consequently, in the present invention, the production method is restricted to the method for producing a high alloy pipe through a step of cold rolling.

FIG. 2 is a plot of the yield strength YS (MPa) values actually obtained by a tensile test against the values obtained by substituting, into the right side of the above-described formula (2), the chemical compositions and the working ratios Rd (%) in terms of the reduction of area, for the various duplex stainless steel pipes used in Example described below, wherein the abscissa represents the value of the right side of formula (2) and the ordinate represents the YS. FIG. 2 shows that as far as the duplex stainless steel pipe is concerned, the yield strength of the duplex stainless steel pipe can be obtained with a satisfactory accuracy, according to formula (2), from the chemical composition of the duplex stainless steel pipe and the working ratio Rd (%) in terms of the reduction of area for the duplex stainless steel pipe.

(f) Accordingly, for the purpose of obtaining a duplex stainless steel pipe having a targeted strength, it is only required to develop, by the cold rolling, the yield strength fraction exclusive of the yield strength developed by the alloying components of the stock, namely, by the contents of Cr, Mo, W and N. Thus, for the purpose of attaining the targeted yield strength MYS (grade of 110 to 140 ksi (the minimum yield strength is 758.3 to 965.2 MPa)), after the selection of the chemical composition of the duplex stainless steel pipe, it is only required to perform the final cold rolling with the working ratio Rd (%) obtained from the above-described formula (2) or the working ratio larger than this working ratio. Consequently, it is only required to perform the cold rolling under the conditions that the working ratio Rd, in terms of the reduction of area in the final cold rolling step, falls within a range from 10 to 80% and additionally the following formula (1) is satisfied:

$$Rd=\exp[\{\ln(MYS)-\ln(14.5\times Cr+48.3\times Mo+20.7\times W+6.9\times N)\}/0.195] \quad (1)$$

wherein Rd and MYS signify the working ratio (%) in terms of the reduction of area and the targeted yield strength (MPa), respectively, and Cr, Mo, W and N signify the contents (mass %) of the individual elements, respectively.

(g) It has also been found that for the purpose of obtaining a duplex stainless steel pipe having a higher strength, namely, a duplex stainless steel pipe having a targeted yield strength MYS (grade of 125 to 140 ksi (the minimum yield strength is 861.8 to 965.2 MPa)), it is only required to regulate the working ratio Rd in terms of the reduction of area in the final cold rolling step to fall particularly within a range from 25 to 80%, or to increase the content of Mo and the content of W in the duplex steel so as to fall within a range from 2 to 6 mass % and within a range from 1.5 to 6 mass %, respectively. Further, it has also been found that when the working ratio Rd in terms of the reduction of area in the final cold rolling step is regulated to fall within a range from 25 to 80% and the content of Mo and the content of W in the duplex steel are increased so as to fall within a range from 2 to 6 mass % and within a range from 1.5 to 6 mass %, respectively, it is possible to produce a duplex stainless steel pipe in which the targeted yield strength is of a higher grade of 140 ksi (the minimum yield strength is 965.2 MPa).

(h) As described above, for the duplex stainless steel pipe, without excessively adding the alloying components, by selecting the cold working conditions, the targeted yield strength can be attained. Consequently, the reduction of the raw material cost can be achieved. Further, by selecting the cold working conditions in conformity with the alloy composition of the stock, the duplex stainless steel pipe having the targeted strength can be obtained, and hence it comes to be unnecessary to perform the melting of a large number of kinds of duplex stainless steels by varying the alloy composition depending on the strength level. Accordingly, the overstock of the material billets can be suppressed.

The present invention has been perfected on the basis of such new findings as described above, and the gist of the present invention is as described in the following items (1) to (4).

(1) A method for producing a duplex stainless steel pipe having a minimum yield strength of 758.3 to 965.2 MPa, comprising:

preparing a duplex stainless steel material pipe for cold working, having a chemical composition consisting, by mass %, of C: 0.03% or less, Si: 1% or less, Mn: 0.1 to 4%, Cr: 20 to 35%, Ni: 3 to 10%, Mo: 0 to 6%, W: 0 to 6%, Cu: 0 to 3% and N: 0.15 to 0.60%, and the balance being Fe and impurities, by a hot working or further by a solid-solution heat treatment; and producing the duplex stainless steel pipe by subsequently subjecting the material pipe to a cold rolling, wherein the cold rolling is performed under the conditions that the working ratio Rd, in terms of the reduction of area, in the final cold rolling step falls within a range from 10 to 80%, and the following formula (1) is satisfied:

$$Rd=\exp[\{\mathrm{In}(MYS)-\mathrm{In}(14.5\times Cr+48.3\times Mo+20.7\times W+6.9\times N)\}/0.195] \quad (1)$$

wherein Rd and MYS signify the working ratio (%) in terms of the reduction of area and the targeted yield strength (MPa), respectively, and Cr, Mo, W and N signify the contents (mass %) of the individual elements, respectively.

(2) A method for producing a duplex stainless steel pipe having a minimum yield strength of 861.8 to 965.2 MPa, comprising:

preparing a duplex stainless steel material pipe for cold working, having a chemical composition consisting, by mass %, of C: 0.03% or less, Si: 1% or less, Mn: 0.1 to 4%, Cr: 20 to 35%, Ni: 3 to 10%, Mo: 0 to 6%, W: 0 to 6%, Cu: 0 to 3% and N: 0.15 to 0.60%, and the balance being Fe and impurities, by a hot working or further by a solid-solution heat treatment; and producing the duplex stainless steel pipe by subsequently subjecting the material pipe to a cold rolling, wherein the cold rolling is performed under the conditions that the working ratio Rd, in terms of the reduction of area, in the final cold rolling step falls within a range from 25 to 80%, and the following formula (1) is satisfied:

$$Rd=\exp[\{\mathrm{In}(MYS)-\mathrm{In}(14.5\times Cr+48.3\times Mo+20.7\times W+6.9\times N)\}/0.195] \quad (1)$$

wherein Rd and MYS signify the working ratio (%) in terms of the reduction of area and the targeted yield strength (MPa), respectively, and Cr, Mo, W and N signify the contents (mass %) of the individual elements, respectively.

(3) A method for producing a duplex stainless steel pipe having a minimum yield strength of 861.8 to 965.2 MPa, comprising:

preparing a duplex stainless steel material pipe for cold working, having a chemical composition consisting, by mass %, of C: 0.03% or less, Si: 1% or less, Mn: 0.1 to 4%, Cr: 20 to 35%, Ni: 3 to 10%, Mo: 2 to 6%, W: 1.5 to 6%, Cu: 0 to 3% and N: 0.15 to 0.60%, and the balance being Fe and impurities, by a hot working or further by a solid-solution heat treatment; and producing the duplex stainless steel pipe by subsequently subjecting the material pipe to a cold rolling, wherein the cold rolling is performed under the conditions that the working ratio Rd, in terms of the reduction of area, in the final cold rolling step falls within a range from 10 to 80%, and the following formula (1) is satisfied:

$$Rd=\exp[\{\mathrm{In}(MYS)-\mathrm{In}(14.5\times Cr+48.3\times Mo+20.7\times W+6.9\times N)\}/0.195] \quad (1)$$

wherein Rd and MYS signify the working ratio (%) in terms of the reduction of area and the targeted yield strength (MPa), respectively, and Cr, Mo, W and N signify the contents (mass %) of the individual elements, respectively.

(4) A method for producing a duplex stainless steel pipe having a minimum yield strength of 965.2 MPa, comprising:

preparing a duplex stainless steel material pipe for cold working, having a chemical composition consisting of, by mass %, C: 0.03% or less, Si: 1% or less, Mn: 0.1 to 4%, Cr: 20 to 35%, Ni: 3 to 10%, Mo: 2 to 6%, W: 1.5 to 6%, Cu: 0 to 3% and N: 0.15 to 0.60%, and the balance being Fe and impurities, by a hot working or further by a solid-solution heat treatment; and producing the duplex stainless steel pipe by subsequently subjecting the material pipe to a cold rolling, wherein the cold rolling is performed under the conditions that the working ratio Rd, in terms of the reduction of area, in the final cold rolling step falls within a range from 25 to 80%, and the following formula (1) is satisfied:

$$Rd=\exp[\{\mathrm{In}(MYS)-\mathrm{In}(14.5\times Cr+48.3\times Mo+20.7\times W+6.9\times N)\}/0.195] \quad (1)$$

wherein Rd and MYS signify the working ratio (%) in terms of the reduction of area and the targeted yield strength (MPa), respectively, and Cr, Mo, W and N signify the contents (mass %) of the individual elements, respectively.

In the chemical compositions of the duplex stainless steel materials used in the present invention, the "impurities" in the balance being "Fe and impurities" mean the substances that contaminate the steel materials when duplex stainless steel pipes are industrially produced, due to the raw materials such as ores and scraps, and due to various other factors in the production process, and are allowed to contaminate within the ranges not adversely affecting the present invention.

Advantageous Effects of Invention

According to the present invention, a duplex stainless steel pipe not only having the corrosion resistance required for oil well pipes used in deep oil wells or in severe corrosive environments but also a targeted strength can be produced without excessively adding alloying components, by selecting the cold working conditions.

DESCRIPTION OF EMBODIMENTS

Figure 1:
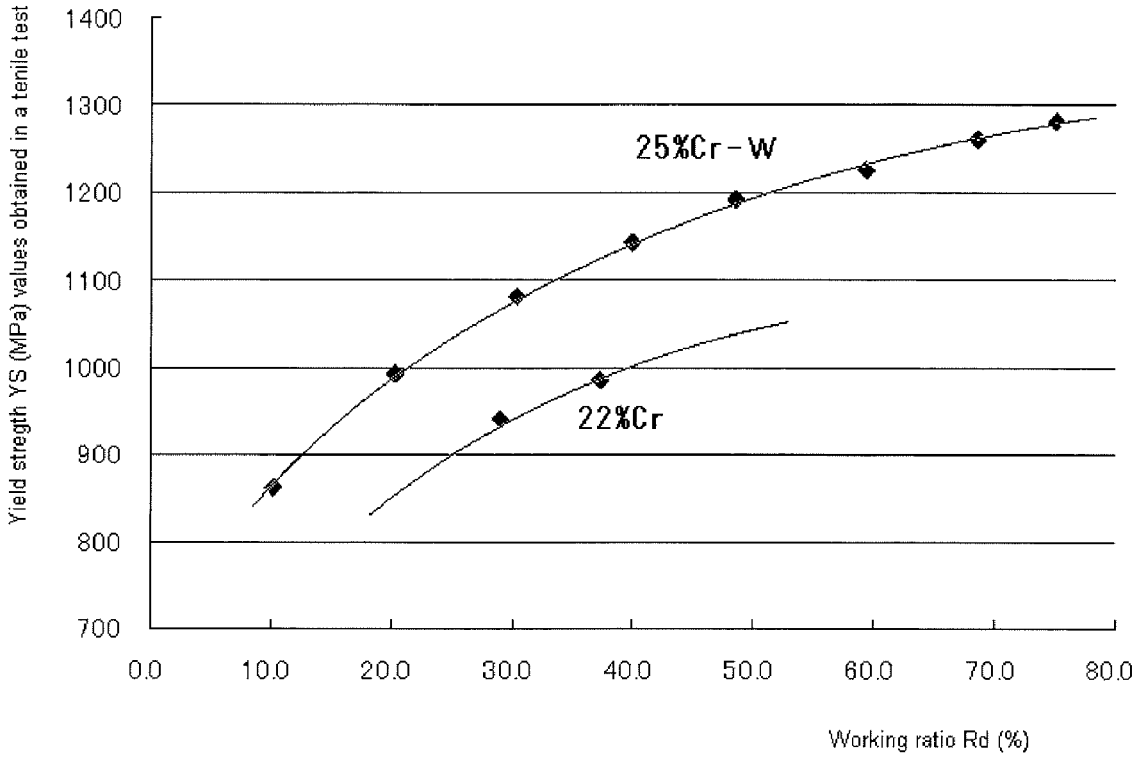
FIG. 1 is the plots, for duplex stainless steel pipes, of the yield strength YS (MPa) values obtained in a tensile test against the working ratio Rd (%) values in terms of the reduction of area.
Figure 2:
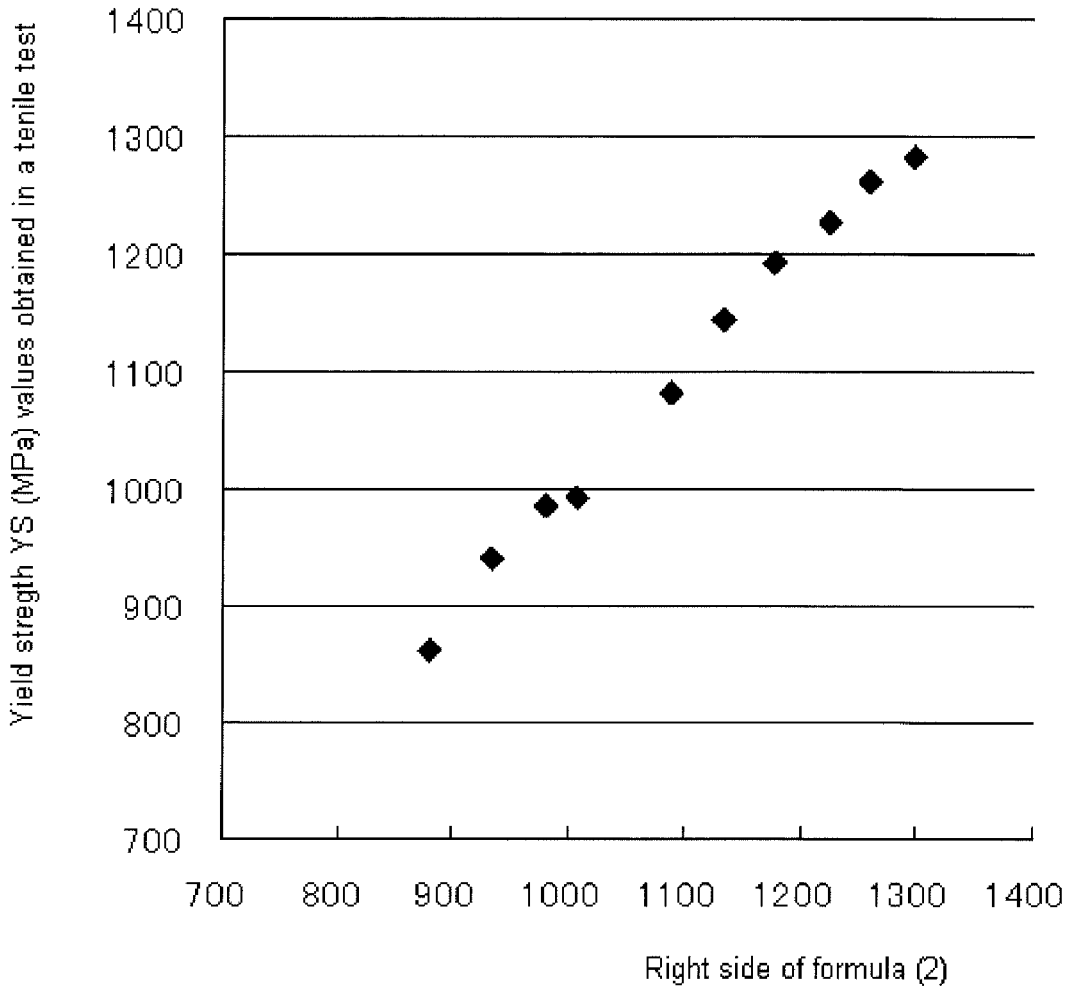
FIG. 2 is a plot, for duplex stainless steel pipes, of the yield strength YS (MPa) values obtained by a tensile test against the values obtained by substituting, into the right side of the above-described formula (2), the chemical compositions and the working ratios Rd (%) in terms of the reduction of area, wherein the abscissa represents the value of the right side of formula (2) and the ordinate represents the YS.

Next, description is made on the reasons for limiting the chemical composition of the duplex stainless steel material used in the method for producing a duplex stainless steel pipe according to the present invention. Here, it is to be noted that "%" in each of the contents of the individual elements represents "mass %."

C: 0.03% or Less

C is an element that has an effect to stabilize the austenite phase to improve the strength, and also has an effect to obtain a microstructure by precipitating carbides at the time of the temperature increase in the heat treatment. However, when the content of C exceeds 0.03%, the precipitation of the carbides comes to be excessive due to the thermal effects at the time of a heat treatment or welding, and thus the corrosion resistance and the workability of the steel are deteriorated. Consequently, the upper limit of the content of C is set at 0.03%. The upper limit of the content of C is preferably 0.02%.

Si: 1% or Less

Si is an element that is effective as a deoxidizer, and also has an effect to obtain a microstructure by precipitating an intermetallic compound at the time of temperature increase in the heat treatment, and hence Si can be contained if necessary. These effects are obtained for the content of Si of 0.05% or more. However, when the content of Si exceeds 1%, the precipitation of the intermetallic compound comes to be excessive due to the thermal effects at the time of a heat treatment or welding, and thus the corrosion resistance and the workability of the steel are deteriorated, and consequently, the content of Si is set at 1% or less. The range of the content of Si is preferably 0.7% or less.

Mn: 0.1 to 4%

Mn is an element that is effective as a deoxidizer similarly to Si as described above, and at the same time fixes S, inevitably contained in the steel, as a sulfide to improve the hot workability. The effect of Mn is obtained with the content of Mn of 0.1% or more. However, when the content of Mn exceeds 4%, the hot workability is deteriorated, and additionally the corrosion resistance is adversely affected. Consequently, the content of Mn is set at 0.1 to 4%. The range of the content of Mn is preferably from 0.1 to 2% and more preferably 0.3 to 1.5%.

Cr: 20 to 35%

Cr is a fundamental component that is effective in maintaining the corrosion resistance and improving the strength. For the purpose of attaining these effects, it is necessary to set the content of Cr at 20% or more. However, when the content of Cr exceeds 35%, the σ-phase tends to be precipitated, and both of the corrosion resistance and the toughness are deteriorated. Consequently, the content of Cr is set at 20 to 35%. For the purpose of obtaining a higher strength, the content of Cr is preferably 23% or more. On the other hand, from the viewpoint of the toughness, the content of Cr is preferably 28% or less.

Ni: 3 to 10%

Ni is an element that is contained to stabilize the austenite phase and to obtain a duplex microstructure. When the content of Ni is less than 3%, the ferritic phase predominates and no duplex microstructure is obtained. On the other hand, when the content of Ni exceeds 10%, austenite phase predominates and no duplex microstructure is obtained, and additionally the economy is impaired because Ni is an expensive element, and hence the content of Ni is set at 3 to 10%. It is preferable to set the upper limit of the content of Ni at 8%.

Mo: 0 to 6% (Inclusive of 0%)

Mo is an element that improves the pitting resistance and the crevice corrosion resistance, and at the same time improves the strength through solid-solution strengthening, and hence Mo can be contained if necessary. When it is intended to obtain the effect of Mo, Mo is preferably contained in a content of 0.5% or more. On the other hand, when Mo is contained excessively, the σ-phase tends to be precipitated and the toughness is deteriorated. Consequently, the content of Mo is preferably set at 0.5 to 6%. When it is intended to obtain a duplex stainless steel pipe having a higher strength, the content of Mo is preferably set at 2 to 6%, and when it is intended to further stabilize the micro-structure and the toughness, the content of Mo is more preferably set at 2 to 4%.

W: 0 to 6% (Inclusive of 0%)

W is an element that, similarly to Mo, improves the pitting resistance and the crevice corrosion resistance, and at the same time improves the strength through solid-solution strengthening, and hence W can be contained if necessary. When it is intended to obtain the effect of W, W is preferably contained in a content of 0.5% or more. On the other hand, when Mo is contained excessively, the σ-phase tends to be precipitated and the toughness is deteriorated. Consequently, the content of W is preferably set at 0.5 to 6%. When it is intended to obtain a duplex stainless steel pipe having a higher strength, the content of W is more preferably set at 1.5 to 6%.

As described above, both Mo and W are not necessarily required to be contained; however, either one or both of Mo and W can be contained. When either one of Mo and W is contained, the preferable contents of Mo and W and the more preferable contents of Mo and W are as described above. When both of Mo and W are contained, it is preferable to set the content of Mo at 0.5 to 6% and the content of W at 0.5 to 6%. When it is intended to obtain a duplex stainless steel pipe having a higher strength, it is more preferable to set the content of Mo at 2 to 6% and the content of W at 1.5 to 6%.

Cu: 0 to 3% (Inclusive of 0%)

Cu is an element that improves the corrosion resistance and the grain boundary corrosion resistance, and Cu can be contained if necessary. When it is intended to obtain the effect of Cu, Cu is preferably contained in a content of 0.1% or more and more preferably in a content of 0.3% or more. However, when the content of Cu exceeds 3%, the effect of Cu is saturated, and adversely the hot workability and the toughness are deteriorated. Consequently, when Cu is contained, the content of Cu is set preferably at 0.1 to 3% and more preferably at 0.3 to 2%.

N: 0.15 to 0.60%

N is an element that enhances the stability of austenite phase, and at the same time enhances the pitting resistance and the crevice corrosion resistance of the duplex stainless steel. Additionally, similarly to C, N has an effect to stabilize the austenite phase and to thereby improve the strength, and hence is an important element for the present invention that attains a high strength. When the content of N is less than 0.15%, no sufficient effect of N is obtained. On the other hand, when the content of N exceeds 0.60%, the toughness and the hot workability are deteriorated, and consequently, the content of N is set at 0.15 to 0.60%. For the purpose of obtaining a higher strength, the lower limit of the content of N is preferably set so as to exceed 0.17%. The upper limit of the content of N is preferably set at 0.35%. The content of N is more preferably 0.20 to 0.30%.

Moreover, on the basis of the below-described reasons, P, S and 0 contained as the impurities are preferably limited in such a way that P: 0.04% or less, S: 0.03% or less and O: 0.010% or less.

P: 0.04% or Less

P is contained as an impurity, and when the content of P exceeds 0.04%, the hot workability is deteriorated, and the corrosion resistance and the toughness are also deteriorated. Consequently, the upper limit of the content of P is preferably set at 0.04%.

S: 0.03% or Less

S is contained as an impurity, similarly to P as described above, and when the content of S exceeds 0.03%, the hot workability is remarkably deteriorated, and additionally, sulfides function as the starting points of the occurrence of pitting to impair the pitting resistance. Consequently, the upper limit of the content of S is preferably set at 0.03%.

O: 0.010% or Less

In the present invention, N is contained in such a larger amount as 0.15 to 0.60%, and hence the hot workability tends to be deteriorated. Consequently, the content of O is preferably set at 0.010% or less.

The duplex stainless steel according to the present invention may further contain one or more of Ca, Mg and the rare earth elements (REMs), in addition to the above-described elements. The reasons why these elements may be contained and the contents of these elements when these elements are contained are as follows.

Ca: 0.01% or Less, Mg: 0.01% or Less and Rare Earth Element(s) (REM(s)): 0.2% or Less of One or More Elements These components can be contained if necessary. When contained, any of these components fixes S that disturbs the hot workability, as a sulfide, and thus has an effect to improve the hot workability. However, when the content of either of Ca and Mg exceeds 0.01%, or the content of the REM(s) exceeds 0.2%, coarse oxides are produced, and the deterioration of the hot workability is caused. Accordingly, when these elements are contained, the upper limits of these elements are set at 0.01% for Ca and Mg, and 0.2% for the REM(s), respectively. It is to be noted that for the purpose of certainly developing the improving effect of the hot workability, it is preferable to contain Ca and Mg each in a content of 0.0005% or more and the REM(s) in a content of 0.001% or more. Herein, the REM is a generic name for the 17 elements which are the 15 lanthanoid elements and Y and Sc, and one or more of these elements can be contained. The content of REMs means the sum of the contents of these elements.

The duplex stainless steel pipe of the present invention contains the above-described essential elements and additionally the above-described optional elements, the balance being Fe and impurities, and can be produced by the production equipment and the production method used for the usual commercial production. For example, for the melting of the duplex stainless steel, there can be used an electric furnace, an Ar—$O_2$ mixed gas bottom blowing decarburization furnace (AOD furnace), a vacuum decarburization furnace (VOD furnace) or the like. The molten steel obtained by melting may be cast into ingots, or may be cast into rod-like billets by a continuous casting method. By using these billets, with an extrusion pipe production method such as the Ugine-Sejournet process or with a hot working such as the Mannesmann pipe making process, a duplex stainless steel material pipe for cold working can be produced. The material pipe after the hot working is converted into a product pipe having an intended strength by cold rolling.

In the present invention, the working ratio at the time of the final cold working is specified, the material pipe for cold working, obtained by the hot working, is subjected to a solid-solution heat treatment if necessary, and thereafter the descaling for removing the scales on the pipe surface is performed, and thus a duplex stainless steel pipe having an intended strength may be produced by one run of cold working. Alternatively, before the final cold working, the solid-solution heat treatment is performed by conducting one or more runs of intermediate cold working, and the final cold rolling may be performed after descaling. By performing an intermediate cold working, the working ratio in the final cold rolling is easily controlled, and at the same time, as compared to the case where the cold working is applied in the state of having been subjected to the hot working, a pipe having a higher-accuracy pipe dimension can be obtained by the final cold working.

EXAMPLE 1

First, the duplex stainless steels having the chemical compositions shown in Table 1 were melted with an electric furnace, and were regulated with respect to the components so as to have approximately the intended chemical compositions, and then, the melting was performed by a method in which by using an AOD furnace, a decarburization treatment and a desulfurization treatment were conducted. Each of the obtained molten steels was cast into an ingot having a weight of 1500 kg and a diameter of 500 mm. Then, the ingot was cut to a length of 1000 mm to yield a billet for use in the extrusion pipe production. Next, by using this billet, a material pipe for cold working was formed by the hot extrusion pipe production method based on the Ugine-Sejournet process.

TABLE 1

| Test | Chemical composition (mass %, the balance: Fe and impurities) | | | | | | | | | | |
|---|---|---|---|---|---|---|---|---|---|---|---|
| No. | C | Si | Mn | P | S | Cr | Ni | Mo | W | Cu | N |
| 1 | 0.017 | 0.31 | 0.49 | 0.025 | 0.0006 | 24.81 | 6.56 | 3.07 | 2.08 | 0.50 | 0.272 |
| 2 | 0.017 | 0.31 | 0.49 | 0.025 | 0.0006 | 24.81 | 6.56 | 3.07 | 2.08 | 0.50 | 0.272 |
| 3 | 0.017 | 0.31 | 0.49 | 0.025 | 0.0006 | 24.81 | 6.56 | 3.07 | 2.08 | 0.50 | 0.272 |
| 4 | 0.017 | 0.31 | 0.49 | 0.025 | 0.0006 | 24.81 | 6.56 | 3.07 | 2.08 | 0.50 | 0.272 |
| 5 | 0.016 | 0.30 | 0.50 | 0.024 | 0.0006 | 25.00 | 6.70 | 3.15 | 2.10 | 0.50 | 0.280 |
| 6 | 0.016 | 0.30 | 0.50 | 0.024 | 0.0006 | 25.00 | 6.70 | 3.15 | 2.10 | 0.50 | 0.280 |
| 7 | 0.016 | 0.30 | 0.50 | 0.024 | 0.0006 | 25.00 | 6.70 | 3.15 | 2.10 | 0.50 | 0.280 |
| 8 | 0.016 | 0.30 | 0.50 | 0.024 | 0.0006 | 25.00 | 6.70 | 3.15 | 2.10 | 0.50 | 0.280 |
| 9 | 0.023 | 0.40 | 1.20 | 0.028 | 0.0005 | 22.50 | 5.10 | 3.20 | 0.12 | 0.20 | 0.175 |
| 10 | 0.023 | 0.40 | 1.20 | 0.028 | 0.0005 | 22.50 | 5.10 | 3.20 | 0.12 | 0.20 | 0.175 |

Each of the obtained material pipes for cold working was subjected to an intermediate cold working, and thereafter subjected to a solution heat treatment under the conditions that water-cooling was performed after being held at 1050 to 1120° C. for 2 minutes or more. Thereafter, the working ratio Rd (%) in terms of the reduction of area was varied so as to have different values as shown in Table 2, and further the final cold working based on the cold rolling using a pilger mill was performed, and thus a duplex stainless steel pipe was obtained. It is to be noted that before the cold rolling was performed, a shotblast was applied to the pipe, and thus the scales on the surface were removed. The dimensions (the outer diameter in mm×the wall thickness in mm) of each of the pipes before and after the final cold working are shown in Table 2.

TABLE 2

| Test No. | Dimensions before the final cold rolling (Outer diameter × wall thickness) | Dimensions after the final cold rolling (Outer diameter × wall thickness) | Rd (%) | Right side of Formula (2) (MPa) | Obtained value YS (MPa) | Obtained value TS (MPa) |
|---|---|---|---|---|---|---|
| 1 | 102 × 6.6 | 63.5 × 6.6 | 39.9 | 1134.7 | 1144.4 | 1268.5 |
| 2 | 102 × 6.6 | 63.5 × 5.5 | 48.5 | 1178.7 | 1192.7 | 1289.2 |
| 3 | 102 × 6.6 | 63.5 × 4.2 | 59.3 | 1225.8 | 1227.1 | 1323.7 |
| 4 | 102 × 6.6 | 63.5 × 3.2 | 68.5 | 1260.8 | 1261.6 | 1365.0 |
| 5 | 46.5 × 7.25 | 25.5 × 3.25 | 75.0 | 1299.8 | 1282.3 | 1371.9 |
| 6 | 70 × 6.5 | 63.5 × 6.5 | 10.2 | 880.8 | 861.8 | 965.2 |
| 7 | 70 × 6.5 | 63.5 × 5.7 | 20.3 | 1007.4 | 992.7 | 1068.6 |
| 8 | 70 × 6.5 | 63.5 × 4.9 | 30.3 | 1089.2 | 1082.4 | 1137.5 |
| 9 | 68.5 × 8.0 | 51.0 × 8.0 | 28.9 | 933.6 | 941.0 | 1006.5 |
| 10 | 68.5 × 9.25 | 51.0 × 8.0 | 37.2 | 980.7 | 985.9 | 1027.2 |

Thereafter, from the obtained duplex stainless steel pipes, arc-shaped tensile test specimens in the pipe axis direction were sampled, and subjected to a tensile test. The observed values as the results of the test, namely, the yield strength YS (MPa) (0.2% yield stress) values and the tensile strength TS (MPa) values in the tensile test are shown in Table 2 together with the numerical values based on the right side of formula (2).

As shown in Table 2, by appropriately selecting the alloy composition and the working ratio Rd in terms of the reduction of area in the cold rolling step, a high alloy pipe having a high strength with a minimum yield strength of 758.3 to 965.2 MPa (grade of 110 to 140 ksi) as the targeted strength can be produced. Further, by setting the working ratio Rd within a range from 25 to 80%, or by increasing the content of Mo and the content of W in the duplex stainless steel to be 2 to 4% and 1.5 to 6%, respectively, a duplex stainless steel pipe having a further higher strength can be produced.

[Industrial Applicability]

The results are as described above, and hence, according to the present invention, a duplex stainless steel pipe that has not only a corrosion resistance that is required for the oil well pipes used in deep oil wells or in severe corrosive environments, but also a targeted strength can be produced, without excessively adding alloying components, by selecting the cold working conditions.

The invention claimed is:

1. A method for producing a duplex stainless steel pipe having a minimum yield strength of 861.8 to 965.2 MPa, comprising:

preparing a duplex stainless steel material pipe for cold working, having a chemical composition consisting, by mass %, of C: 0.03% or less, Si: 1% or less, Mn: 0.1 to 4%, Cr: 20 to 35%, Ni: 3 to 10%, Mo: 2 to 6%, W: 1.5 to 6%, Cu: 0 to 3% and N: more than 0.17% and not more than 0.60%, and the balance being Fe and impurities, by a hot working and optionally by a solid-solution heat treatment; and producing the duplex stainless steel pipe by subsequently subjecting the material pipe to a cold rolling, wherein the cold rolling is performed under the conditions that the working ratio Rd, in terms of the reduction of area, in the final cold rolling step falls within a range from 10 to 80%, and the following formula (1) is satisfied:

$$Rd=\exp[\{\ln(MYS)-\ln(14.5\times Cr+48.3\times Mo+20.7\times W+6.9\times N)\}/0.195] \quad (1)$$

wherein Rd and MYS signify the working ratio (%) in terms of the reduction of area and the targeted yield strength (MPa), respectively, and Cr, Mo, W and N signify the contents (mass %) of the individual elements, respectively.

2. A method for producing a duplex stainless steel pipe having a minimum yield strength of 965.2 MPa, comprising:

preparing a duplex stainless steel material pipe for cold working, having a chemical composition consisting of, by mass %, C: 0.03% or less, Si: 1% or less, Mn: 0.1 to 4%, Cr: 20 to 35%, Ni: 3 to 10%, Mo: 2 to 6%, W: 1.5 to 6%, Cu: 0 to 3% and N: more than 0.17% and not more than 0.60%, and the balance being Fe and impurities, by a hot working and optionally by a solid-solution heat treatment; and producing the duplex stainless steel pipe by subsequently subjecting the material pipe to a cold rolling, wherein the cold rolling is performed under the conditions that the working ratio Rd, in terms of the reduction of area, in the final cold rolling step falls within a range from 25 to 80%, and the following formula (1) is satisfied:

$$Rd=\exp[\{\ln(MYS)-\ln(14.5\times Cr+48.3\times Mo+20.7\times W+6.9\times N)\}/0.195] \quad (1)$$

wherein Rd and MYS signify the working ratio (%) in terms of the reduction of area and the targeted yield strength (MPa), respectively, and Cr, Mo, W and N signify the contents (mass %) of the individual elements, respectively.

* * * * *